US006109429A

United States Patent [19]

Cunningham et al.

[11] Patent Number: 6,109,429

[45] Date of Patent: Aug. 29, 2000

[54] APPARATUS FOR STORING TOILETRIES

[76] Inventors: John Walter Cunningham; Linda Elizabeth Cunningham, both of 552 N. McCarran #294, Sparks, Nev. 89431

[21] Appl. No.: 09/267,270

[22] Filed: Mar. 12, 1999

[51] Int. Cl.[7] ..... A45D 44/18

[52] U.S. Cl. ..... 206/15.2; 206/225; 206/823; 4/255.11

[58] Field of Search ..... 206/15.2, 15.3, 206/225, 349, 361, 362.3, 581, 823; 4/255.11; D6/524, 551; 312/206

[56] References Cited

U.S. PATENT DOCUMENTS

| | | | |
|---|---|---|---|
| 3,429,474 | 2/1969 | Cann | 312/206 |
| 4,008,933 | 2/1977 | Wanek | 312/206 |
| 4,211,750 | 7/1980 | Gillespie | 206/361 |
| 5,307,930 | 5/1994 | Wilk et al. | 206/349 |
| 5,890,588 | 4/1999 | Leonard et al. | 206/15.3 |
| 5,924,566 | 7/1999 | Gibbs | 206/15.3 |
| 5,958,150 | 9/1999 | Borger et al. | 206/15.3 |
| 5,971,141 | 10/1999 | Shafik | 206/225 |

*Primary Examiner*—Paul T. Sewell
*Assistant Examiner*—Luan K. Bui
*Attorney, Agent, or Firm*—Skinner, Sutton, Watson & Rounds; Adrienne Yeung

[57] ABSTRACT

This invention provides storage to hold a number of toilet related items within easy reach of the user of the toilet. The items are easily accessible, enclosed in a fashionable container, and is able to occupy a small area. The apparatus includes a base member, a side member, and a top member to enclose the items held within the container. The top member may be user removable, or there may be an alterative access means such as a door or the like in the side member of the device.

20 Claims, 4 Drawing Sheets

FIG. 1
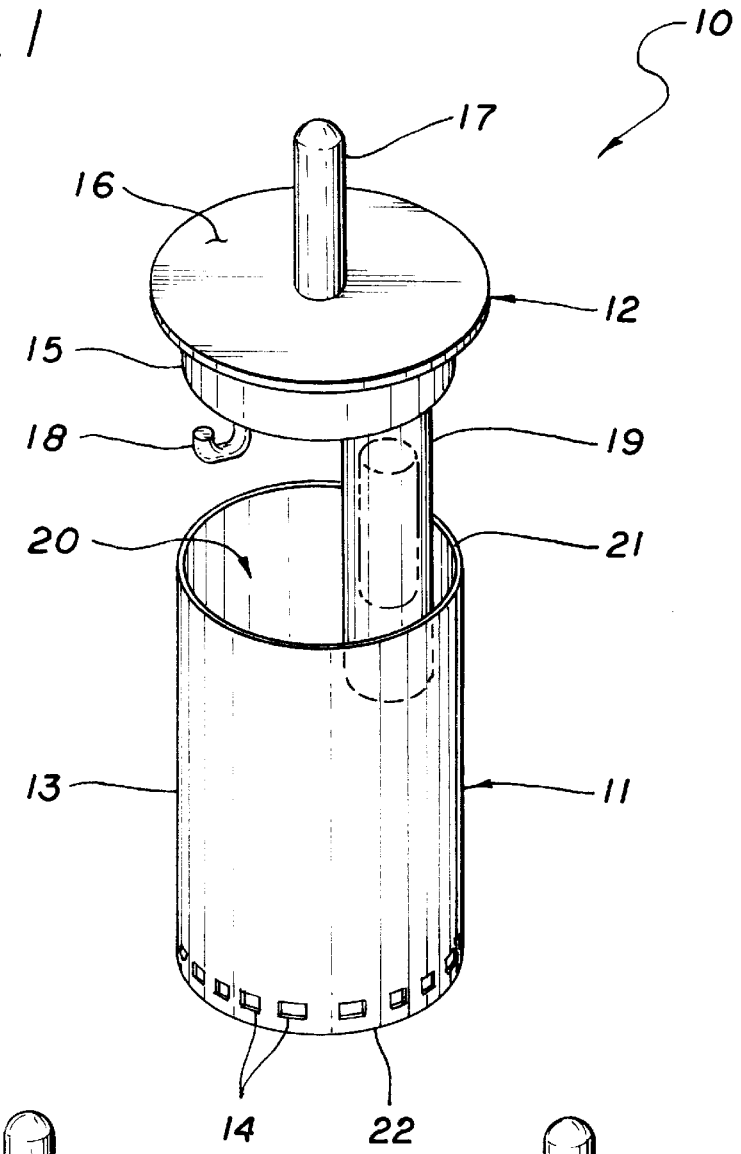
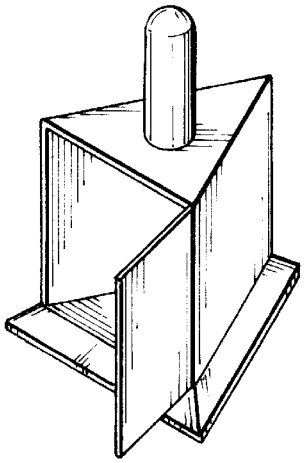
FIG. 2
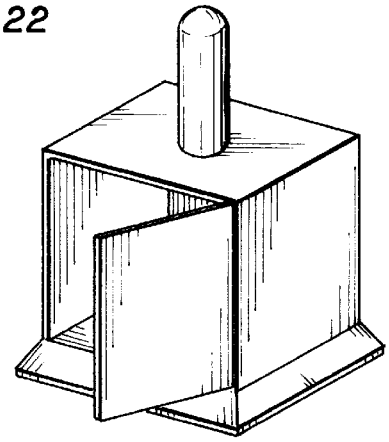
FIG. 3

APPARATUS FOR STORING TOILETRIES

BACKGROUND OF THE INVENTION

1. Field of the Invention

This invention relates to storage devices; in particular, this invention relates to an apparatus for the storage of toiletries; more particularly, this apparatus relates to the storage of toiletries conveniently and within easy access, while providing a fashionable bathroom accessory.

2. State of the Art

One new architectural development is the placing of toilets in water closets. In the case of this architectural design, most water closets are closed off rooms within the larger bathroom area, which contains the sink and bath areas of the house. The water closet is an independent area closed off room the bath area. People generally want toiletries to be easily accessible and within arms-length reach when needed, the classic example being running out of toilet tissue at which time it is universally preferred to have a new roll of toilet tissue paper be within the user's reach and not in a cabinet or storage area away from the toilet. Since the space between the toilet and sink is a common area to store toiletries, this area is inaccessible to the user of the toilet during use of the toilet. Moreover, only a few items may be placed in the small area provided under the sink.

Traditionally, toiletries are customarily stored in bathrooms, the most logical area for placement of such items. Given the modern construction trend to the construction of small water closet rooms within the bathroom complex, the room being the place of actual location for the toilet, there is a need for storage of toiletries and similar toilet specific items. Since the water closets are small they typically do not have the storage or cabinet space necessary for storing items specific to the operation of a toilet such as a plunger, toilet cleaning utensils such as the brush and toilet cleanser, toilet tissue paper, or a can of spray air freshener. Naturally the user of the toilet would ideally want the items to be within reach when using the toilet to prevent an embarrassing hunt for items during an interrupted use of the toilet. This problem can become acute, for example, in mobile homes, and the like, where there are no convenient cabinets or any other storage spaces proximate to the toilet to place toilet specific items.

Currently, no containers or storage units are known that allow the placement of toilet specific items in a convenient area in a water closet or near a toilet of any other design. While one could build shelving or other means in the water closet room, such procedures involve actual reconstruction of the water closet room. Moreover, such means tend to occupy a fair amount of wall space, moreover these means may interfere with the use of the toilet by the user. Finally, such massive reconstruction is expensive and unsightly.

Therefore, there is plainly a need to provide a means for storing toilet related items within arms reach for the user of the toilet. Ideally such means would not involve reconstruction of the water closet in any manner, and would allow for convenient storage of multiple toiletries while occupying a small area. Moreover, the means would be executed in a manner that would provide a stylish accent to the water closet.

SUMMARY OF THE INVENTION

This invention provides storage to hold a number of toilet related items within easy reach of the user of the toilet. The items are easily accessible, enclosed in a fashionable container, and are able to occupy a small area. The apparatus includes a base member, a side member, and a top member to enclose the items held within the container. The top member may be user removable, or there may be an alterative access means such as a door or the like in the side member of the device.

In one preferred aspect of this invention, an apparatus for storing toiletries, comprises:

a side member having a first end and a second end, the side member defining an elongate interior opening, and resting on the first end;

a top member attached to the side member at the second end;

means for accessing the elongate interior opening;

means for receiving tools within the elongate interior opening, at least one of said tools having an elongate handle, the handle disposed to extend past the second end into an interior opening defined in said top member.

In another preferred aspect, this invention is an apparatus for storing toiletries, comprising:

a bottom member;

a side member having a first end and a second end, the side member defining an elongate interior opening, and the side member resting on the bottom member on the first end;

a top member attached to the side member at the second end;

means for accessing the elongate interior opening;

means for receiving tools within the elongate interior opening, at least one of said tools having an elongate handle, the handle disposed to extend past the first end into an interior opening defined in said top member.

BRIEF DESCRIPTION OF THE DRAWING

FIG. 1 shows a perspective and exploded view of one embodiment of the apparatus of this invention.

FIG. 2 shows a perspective view of a different embodiment of this invention.

FIG. 3 shows a perspective view of yet another different embodiment of this invention showing different shapes and means to access the interior of the unit of this invention.

DETAILED DESCRIPTION OF THE PREFERRED EMBODIMENT

Figure 4:
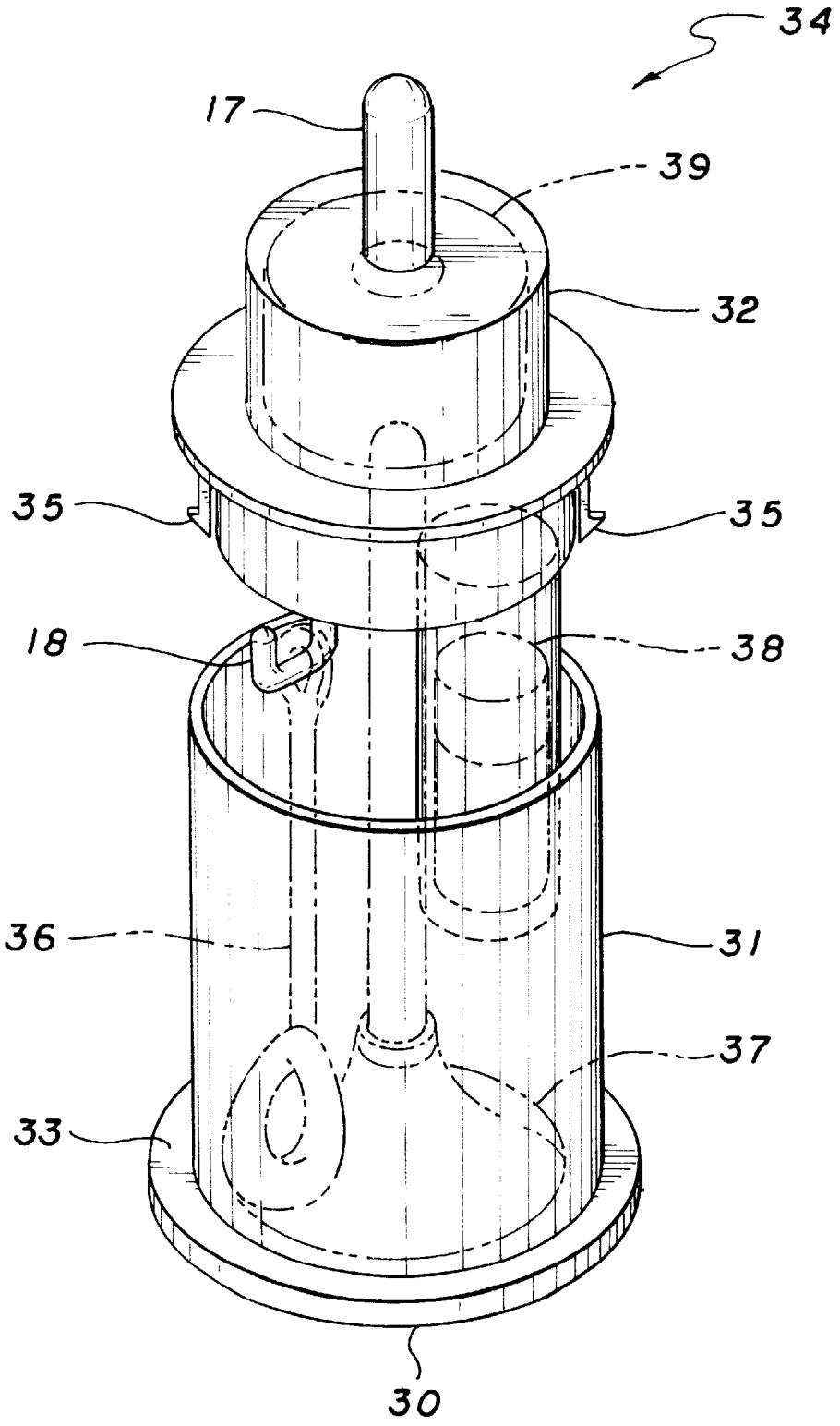
FIG. 4 shows a perspective and exploded view of another possible embodiment of the apparatus of this invention.

Referring to FIG. 1, a toilet item storage unit 10, includes a hollow member 11 and a top member 12. The base member 11 includes a side member 13, the side member 13 defines a plurality of venting apertures 14. Moreover, the side member forms a substantially hollow container 20 for the placement of objects.

The toilet item storage unit 10 has a side member 13 having a first end 22 and a second end 21, the side member defining an elongate interior opening 20. The storage unit rests on the first end. On the second end is a top member 12 which may be placed on or attached to the side member at the second end. In the embodiment shown in FIG. 1, the elongate interior opening is accessed by removing the top member 12 from the resting place on the side member 13. A variety of tools may be received within the elongate interior opening. As shown in the Fig., a hook 18 can receive a hanging device, for example a toilet bowl brush cleaning device, and a can may be received by the canister holder 19. At least one of these tools may have an elongate handle and the handle can be readily disposed to extend past the first end into an interior opening defined in said top member.

The hollow member and the sides are preferably formed from a type of moldable plastic. Preferably the plastic would be injection molded, but, other forms of fabrication are not precluded. Moreover, the base member and the sides may also be made of alternative materials, for example, metal, examples including steel, brass, or aluminum, or, for example, glass, or other types of similar materials. The base member 11 and top member 12 may be made into varying shapes.

The top member 12 has a mating member 15 which mates with the side 13 and a top surface 16. This prevents the top from accidentally being jarred off when not in use. A handle 17 extends upwardly from the top surface 16 of the top member 12. There is also a hook means 18 extending downwardly from the top member 12 into the cavity formed by the side wall 13. Similarly, a container holding means 19 also extends downwardly from the top surface 16 into the cavity formed by the side wall 13.

The hook 18 is exemplary of any means to hang an object from, other such means including bars, latches, or other securing means. Objects that can be held by the hook include a toilet cleaning brush, which may be of any shape and size for items of similar use. It is preferred that any toilet brush of commerce be used in this invention. The container holding means 19 includes any means that is able to hold a container, such as an air freshener spray can or other such similar objects, and may take the form of any shape and size. There may be one or more hooks in the toilet item storage unit of the present invention. Other items may be located in the bottom of the unit for retrieval as necessary, although that is not preferred.

Referring now to FIG. 2 the toilet item storage unit may come in a variety of different shapes. For example, as shown in FIG. 2 the toilet item storage unit may be triangular. In the embodiment shown in FIG. 2, the toilet item storage unit has a door opening for access to the tools contained within, rather than a removable top. The wide base shown in FIG. 2 provides a degree of stability that may be beneficial for use where the storage unit is exposed to jostling and the like.

Referring now to FIG. 3, the toilet item storage unit may be square. Similarly to the embodiment shown in FIG. 2, the embodiment shown in FIG. 3 has a front opening door for providing access to the interior of the storage unit. Alternatives could include those where the top is removable and the items are accessed by removing the top. The shape of the unit is not critical and other such embodiments may be formed in shapes such as circular, as in FIG. 1, oval, hexagonal, octagonal, or even fanciful shapes such as figure of humans or animals.

Referring to FIG. 4, the toilet item storage unit 34 of this embodiment is largely similar to the one shown for FIG. 1, except that here a spare roll of toilet paper 39 is shown being stored on the top extension. The bottom member 30, connects with the side 31 forming a substantially hollow container having a bottom. In this embodiment, the bottom is shown having an overhang or flare 33 that can be weighted to provide extra stability to the device. Various toiletries (shown in phantom) such as the toilet cleaning brush 36, a plunger 37, and an air freshener can 38 are all easily stored within the cavity created by the side member of the toilet item storage unit.

In this embodiment, a substantially hollow covering means 32 is placed over the roll of toilet tissue disposed on the top surface 33 (shown in phantom). The covering means may be used to cover toilet tissue paper 39 or any other similar item, for example wipes, towels or the like will beneficially be placed here. Latching members 35 connected to the top member and the side may be used to connect the base with the top member and allow a consumer to carry the apparatus. The latching members may comprise any conventional means for latching one member to another for easy and facile removal. Threaded means for removably securing can be used, as can variations of the mortise and tenon idea.

Figure 5:
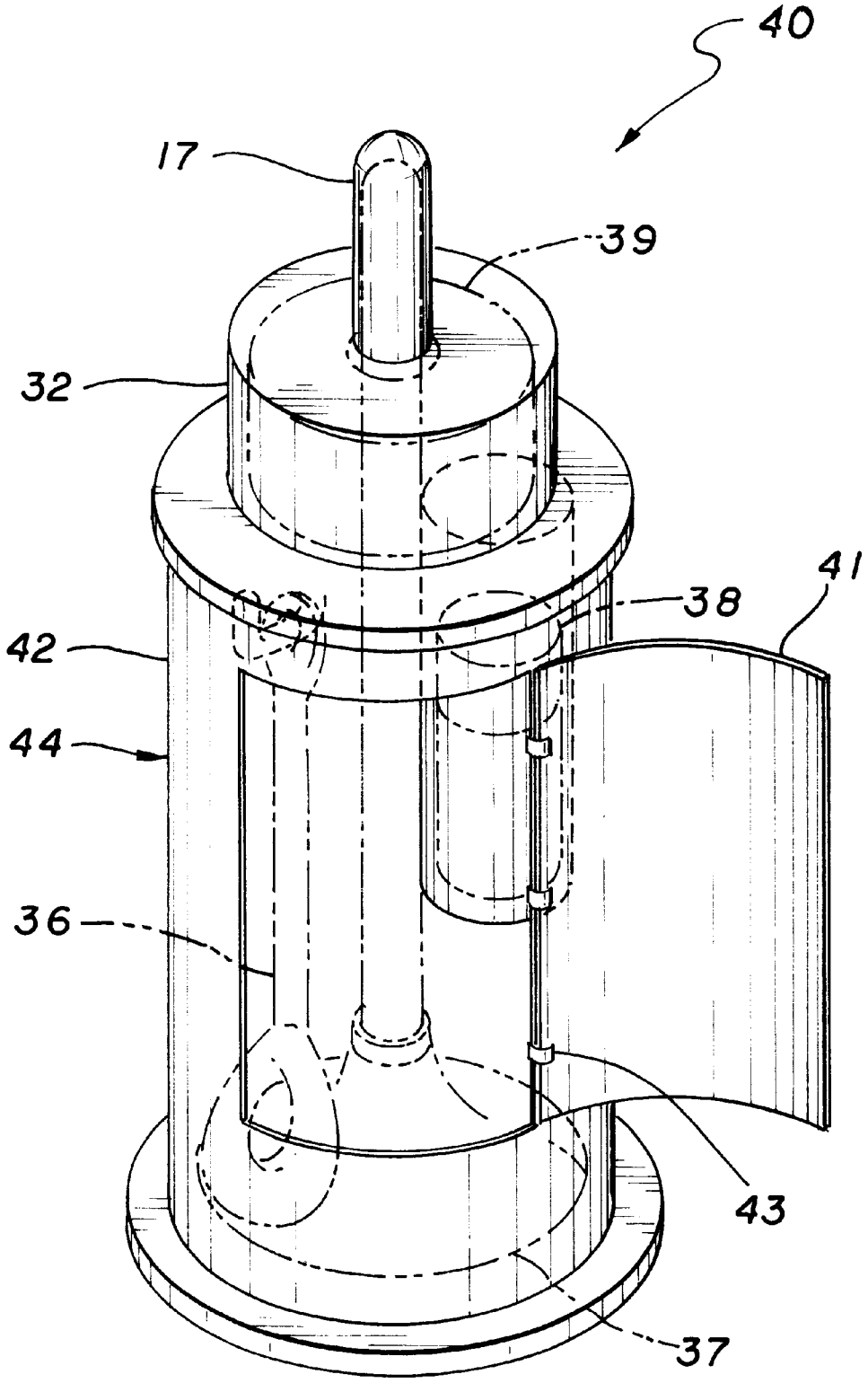
FIG. 5 shows a perspective view of yet another possible embodiment of the apparatus of this intention.

Now referring to FIG. 5, another embodiment of the toilet item storage unit 40 may comprise a door member 41, the door member 41 connected to the side 42 by hingeable connecting means 43. The door member may be used on any geometry of the toilet item storage unit of this invention. Although clearly the invention need not have a door, the door allows one facile method to retrieve the toiletries, as shown in phantom, contained within the substantially hollow container 44. Moreover, the door need not be hinged. In one alternative, for example, the apparatus may have a sliding door riding on tracks on which to slide the door open and closed. Additionally, the connecting means 43 is any means, such as the hinge shown in the Fig., that will connect the door member 41 to the side 42 and allow the door member 41 to open and close, but may be any other connecting means that will allow facile opening and closing. The connecting means 43 may be one that requires only one piece of hardware, or, as shown, it may require a plurality of connecting means pieces.

Figure 6:
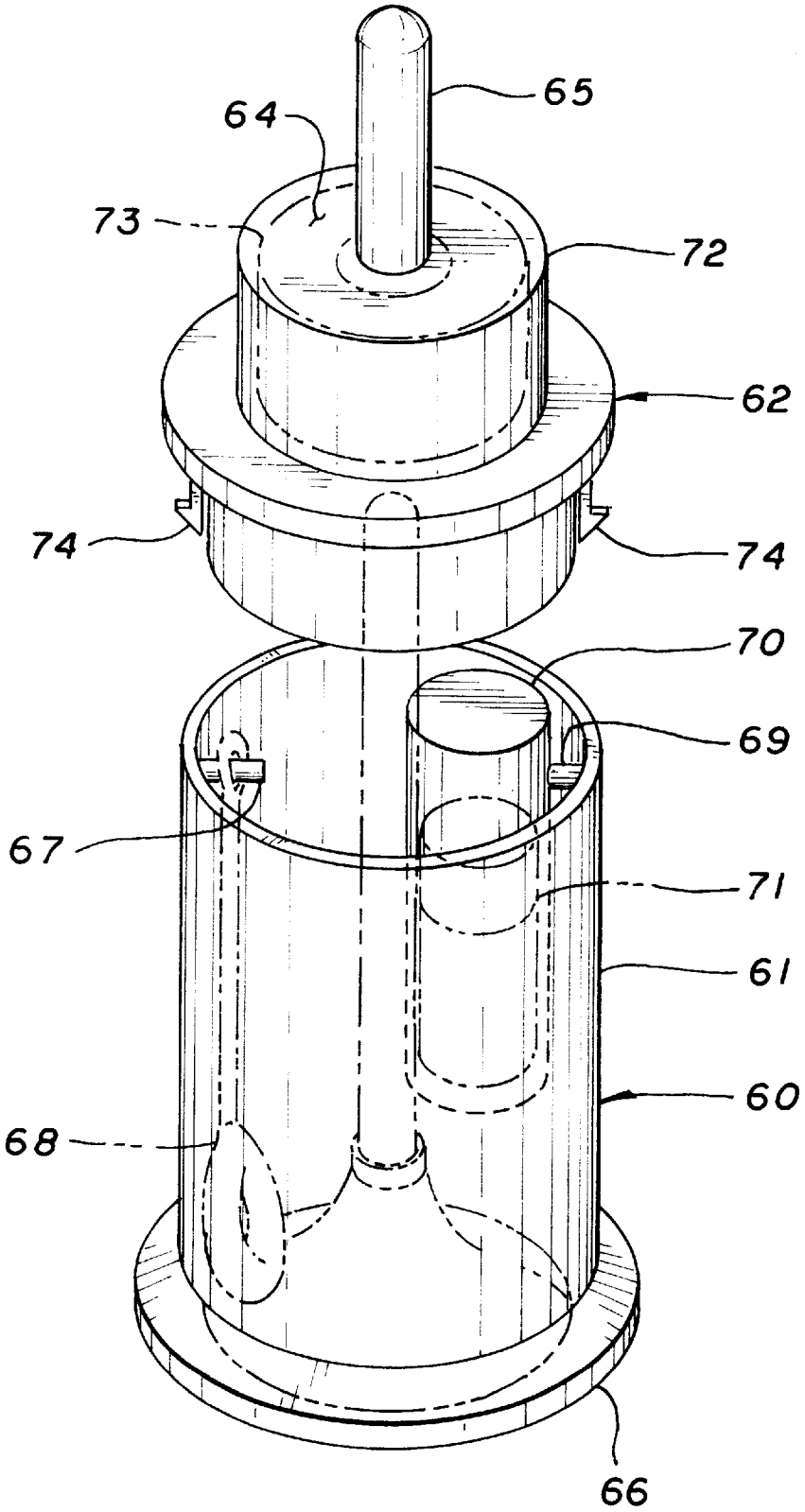
FIG. 6 shows a perspective and exploded view of yet one more possible embodiment of the apparatus of this invention.

Now referring to FIG. 6, the toilet item storage unit of this invention may store the toilet specific items on the wall member, rather than hanging from the top member. The apparatus has a base member 60 with a side 61, the side forming a substantially hollow container. A top member 62 has resilient mating member 74 and a top surface 64, the mating member 74 mating with an indentation in the side member 61. An extension for the handle of the length of the plunger 65 extends upwardly from the top surface 64 and bottom member 66 receives the side 61 forming a substantially hollow container. In this embodiment, the items are supported by means mounted on the wall of the toilet item storage unit of this invention.

There is a first rod 67 extending outwardly from the side member. The rod may be of any configuration and be a hook member, or a curved member or any similar shape. The rod extends outwardly parallel to the bottom member. The rod may support the various toilet specific items (shown in phantom). As in the previous embodiments, the rod may be used to hold such toiletries as a toilet cleaning brush 68, as shown in phantom. There may be a plurality of rods on the side member and in the Fig. a second rod 69 extends outwardly from the side 61, opposite the first rod 67. This second rod 69 has a container holding means 70 extending downwardly therefrom. The container holding means may be used to hold toiletries such as a spray can 71, as shown in phantom. The first rod can be a side hook extending outwardly from the side member, distal the bottom member into the elongate interior opening; and the second rod may be substituted with any conventional means for holding containers extending outwardly from the side member into the elongate interior opening, opposite the side hook.

This embodiment may also contain a substantially hollow covering means 72 disposed on the top surface 64 to hold such toiletries as toilet tissue paper 73, as shown in phantom. A plurality of latching means 74 may be connected to the top member 62 to secure the top member to the bottom member This invention has been described by reference to specific examples and embodiments, which will bring alternative embodiments, modifications and variations to the minds of those skilled in the art. The appended claims are intended to encompass all such alternatives, modifications, and variations.

What is claimed is:

1. An apparatus including a toilet item storage unit and toilet tools, the apparatus comprising:

a side member having a first end and a second end, the side member defining an elongate interior opening, and resting on the first end;

a top member attached to the side member at the second end;

means for accessing the elongate interior opening;

means for receiving toilet tools within the elongate interior opening, at least one of said toilet tools having an elongate handle, the handle disposed to extend into an interior opening of an extension of the said top member and, means for receiving toilet tools attached to the top member.

2. The apparatus of claim 1, wherein the side member further includes a side wall defining at least one aperture.

3. The apparatus of claim 1, wherein means for receiving tools includes a hook extending downwardly into the elongate interior opening and a means for holding containers extending downwardly into the elongate interior opening.

4. The apparatus of claim 1, wherein the toilet item storage unit further comprises:

a bottom member, attached to the side member defining an elongate interior opening, at the first end forming a substantially hollow container having a bottom.

5. The apparatus of claim 1, wherein the toilet item storage unit further comprises:

a cover disposed over and covering an extension of the top member formed by the interior opening defined within said top member.

6. The apparatus of claim 1 wherein the top member is removably attached to the second end of the side member.

7. The apparatus of claim 6 wherein the top member is lockably attached to the side member.

8. The apparatus of claim 1 wherein the extension of the top member forms a vertical spare toilet paper roll holder.

9. The apparatus of claim 8, wherein the toilet item storage unit further comprises:

a cover disposed over and covering the vertical spare toilet paper roll holder.

10. The apparatus of claim 1, wherein the side member further includes a door member, the door member connected to the side member by a means for hingeably opening the door member.

11. An apparatus including a toilet item storage unit and toilet tools, the apparatus comprising:

a bottom member;

a side member having a first end and a second end, the side member defining an elongate interior opening, and the side member resting on the bottom member on the first end;

a top member attached to the side member at the second end;

means for accessing the elongate interior opening;

means for receiving toilet tools within the elongate interior opening, at least one of said toilet tools having an elongate handle, the handle disposed to extend into an interior opening of an extension of the said top member, and means for receiving toilet tools attached to the top member.

12. The apparatus of claim 11, further comprising:

a side hook extending outwardly from the side member, distal the bottom member into the elongate interior opening; and a means for holding containers extending outwardly from the side member into the elongate interior opening, opposite the side hook.

13. The apparatus of claim 11, wherein the side member further includes a side wall defining at least one aperture.

14. The apparatus of claim 11, wherein the toilet item storage unit further comprises:

a bottom member, attached to the side member at the first end forming the substantially hollow container having a bottom.

15. The apparatus of claim 11, wherein the toilet item storage unit further comprises:

a cover disposed over and covering an extension of the top member formed by the interior opening defined within said top member.

16. The apparatus of claim 11 wherein the top member is removably attached to the second end of the side member.

17. The apparatus of claim 16 wherein the top member is lockably attached to the side member.

18. The apparatus of claim 11 wherein the extension of the top member forms a vertical spare toilet paper roll holder.

19. The apparatus of claim 18, wherein the toilet item storage unit further comprises:

a cover disposed over and covering the vertical spare toilet paper roll holder.

20. The apparatus of claim 11, wherein the side member further includes a door member, the door member connected to the side member by a means for hingeably opening door member.

* * * * *